US010468856B2

(12) United States Patent
Niessner et al.

(10) Patent No.: US 10,468,856 B2
(45) Date of Patent: Nov. 5, 2019

(54) SPARK PLUG DEVICE AND METHOD OF MANUFACTURING SPARK PLUG DEVICE

(71) Applicant: Federal-Mogul Ignition GmbH, Neuhaus-Schierschnitz (DE)

(72) Inventors: Werner Niessner, Steinheim (DE); Andreas Zeh, Sonneberg (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 15/973,096

(22) Filed: May 7, 2018

(65) Prior Publication Data

US 2018/0323583 A1 Nov. 8, 2018

(30) Foreign Application Priority Data

May 8, 2017 (DE) ..... 10 2017 109 844

(51) Int. Cl.

*H01T 13/08* (2006.01)
*H01T 21/02* (2006.01)
*F02F 11/00* (2006.01)

(52) U.S. Cl.

CPC ..... *H01T 13/08* (2013.01); *H01T 21/02* (2013.01); *F02F 11/002* (2013.01)

(58) Field of Classification Search

USPC ..... 123/169 EL
See application file for complete search history.

(56) References Cited

U.S. PATENT DOCUMENTS

| | | | | |
|---|---|---|---|---|
| 2,921,109 | A | 1/1960 | Novak | |
| 3,156,477 | A | 11/1964 | Hopp | |
| 4,241,491 | A | 12/1980 | Hopp | |
| 7,477,006 | B2 | 1/2009 | Fukuzawa et al. | |
| 7,914,353 | B2 | 3/2011 | Kobayashi et al. | |
| 8,704,434 | B2 * | 4/2014 | Moritani | H01T 21/02 313/135 |
| 8,952,603 | B2 | 2/2015 | Kobayashi | |
| 9,190,812 | B2 | 11/2015 | Miyashita et al. | |
| 9,194,494 | B2 | 11/2015 | Suzuki | |
| 9,422,911 | B2 | 8/2016 | Kawashima | |
| 9,455,553 | B2 | 9/2016 | Shimamura et al. | |
| 2015/0171598 | A1 | 6/2015 | Suzuki | |
| 2015/0176520 | A1 | 6/2015 | Berger et al. | |
| 2015/0194792 | A1 * | 7/2015 | Shimamura | F02P 13/00 313/144 |
| 2015/0311678 | A1 | 10/2015 | Niessner et al. | |
| 2015/0311679 | A1 * | 10/2015 | Niessner | H01T 13/32 313/141 |

(Continued)

FOREIGN PATENT DOCUMENTS

| | | | |
|---|---|---|---|
| DE | 10338743 | A1 | 3/2005 |
| DE | 102016110880 | A1 | 12/2016 |

(Continued)

*Primary Examiner* — Ashok Patel
(74) *Attorney, Agent, or Firm* — Reising Ethington, P.C.

(57) ABSTRACT

A spark plug device that includes a spark plug and a sealing ring, and a method for producing the same. The spark plug may include a body, an insulator, a center electrode, and a ground electrode. The sealing ring is secured to the body in a captive fashion. A fastening section of the body has an outer diameter that is greater than an inner diameter of the sealing ring, which has been reshaped from a flat sealing ring blank into a conical sealing ring.

10 Claims, 2 Drawing Sheets

(56) References Cited

U.S. PATENT DOCUMENTS

2016/0365706 A1* 12/2016 Bowman ..... H01T 21/00

FOREIGN PATENT DOCUMENTS

| | | | | | |
|---|---|---|---|---|---|
| EP | 2950405 | A1 | | 12/2015 | |
| FR | 2491689 | A1 | * | 4/1982 | ..... H01T 13/08 |
| FR | 2491689 | A1 | | 4/1982 | |
| GB | 839468 | A | | 6/1960 | |
| JP | 5369227 | B1 | | 12/2013 | |
| JP | 5755128 | B2 | | 7/2015 | |
| WO | 2013008371 | A1 | | 1/2013 | |
| WO | 20130164130 | A1 | | 11/2013 | |

* cited by examiner

SPARK PLUG DEVICE AND METHOD OF MANUFACTURING SPARK PLUG DEVICE

This application claims the benefit of German Application No. 10 2017 109 844.5, filed on May 8, 2017, the contents of which are hereby incorporated by reference in their entirety.

FIELD

The present invention relates to a spark plug device and a method for producing a spark plug device; the spark plug device is embodied especially for internal combustion engines, in particular motor vehicles.

BACKGROUND

Spark plugs are used to initiate combustion in internal combustion engines. Typically, spark plugs ignite a gas such as a fuel/air mixture in a combustion chamber by producing a spark across a spark gap, which is defined by two or more spark plug electrodes. The ignition of the gas by means of the spark produces a combustion reaction that in turn drives a piston inside an engine cylinder during a power stroke of the internal combustion engine.

The spark plug is generally accommodated in a spark plug socket of a cylinder head of the internal combustion engine. The spark plug socket has an internal thread. A fastening section of the spark plug is embodied with an externally threaded section so that the spark plug can be screwed into the spark plug socket of the cylinder head.

The general goal is to prevent exhaust gas from escaping during the combustion process. The escape of exhaust gas can occur if the exhaust gas flows along the thread engagement between the spark plug and the spark plug socket and out of the cylinder head of the internal combustion engine. In order to reduce or prevent a leakage of this kind, most spark plugs include a washer-like sealing ring. When the spark plug is installed in the spark plug socket of the cylinder head by means of thread engagement, the sealing ring is compressed between a shoulder of a metal sleeve of the spark plug and a cylinder head sealing surface. The compressed sealing ring then produces a gastight seal between the spark plug and the sealing surface of the cylinder head.

Depending on the design, spark plugs may be embodied with different thread types, for example M8, M10, M12, etc. In addition to different thread types, there are also different seat shapes. In this connection, the classic spark plug has a flat seat with the above-mentioned sealing ring. In addition to such a classic embodiment, however, there are also spark plugs with a conical seat that do not require a sealing ring (ISO 28741 or Wikipedia, keyword "spark plug" https://en.wikipedia.org/wiki/Spark_plug#Sealing_to_the_cylinder_head).

From document DE 10 2016 110 880 A1, it is known that the effectiveness of the gastight seal can be influenced by the material or composition of the sealing surface of the cylinder head. In order to reduce the weight of the vehicle, cylinder heads can be made of innovative production methods, for example a lost-foam casting process, in order to produce cylinder heads from light metal alloys. The cylinder blocks produced in this case have a more porous surface against which it can be difficult to achieve a seal. In addition, the challenge of producing a good seal can be made more difficult by the fact that during the installation process, the sealing ring is crushed or deformed in some other way so that a sealing surface thereof is no longer flat and planar.

In this connection, it is known from document DE 10 2016 110 880 A1 to slide a sealing ring over a fastening section of a metal sleeve of a spark plug and then to reshape the sealing ring into a post-formed [shape-adjusted] sealing ring, which has an inner diameter that is smaller than the outer diameter of the fastening section; the sealing ring that is reshaped in this way is flat and has an essentially uniform thickness.

U.S. Pat. No. 8,704,434 B2 discloses a spark plug with a conical sealing surface on the metal sleeve, which is designed to cooperate directly with a cylinder head sealing surface. In this case, protruding annular sections should be provided on the conical surface of the metal sleeve.

U.S. Pat. No. 9,422,911 B2 discloses a spark plug with a metal sleeve that has a sleeve sealing surface extending essentially perpendicular to a longitudinal axis. A sealing ring has sealing surfaces that are inclined. For installation in a cylinder head, this sealing ring is then compressed between sealing surfaces of a metal sleeve and a cylinder head, which are oriented perpendicular to a longitudinal axis.

U.S. Pat. No. 9,190,812 B2 discloses the production of a sealing ring on a spark plug in which the sealing ring is deformed against a sealing surface that is oriented perpendicular to the longitudinal axis in order to reduce the inner diameter of the sealing ring and affix the sealing ring to the metal sleeve in captive fashion.

Finally, U.S. Pat. No. 2,921,109 A discloses a spark plug with a sealing ring that is compressed between a sealing surface of a metal sleeve of the spark plug, which surface is oriented perpendicular to the longitudinal axis and a conical cylinder head sealing surface.

SUMMARY

One object of the present design is to disclose an improved spark plug device and an improved method for producing a spark plug device.

According to a first aspect, the above object may be attained by a spark plug device that has a spark plug and a sealing ring. The spark plug includes a body which has an axial bore, a fastening section for fastening the spark plug to a cylinder head, and a sleeve sealing surface that is conical in at least some sections. In addition, the spark plug has an insulator, which includes a longitudinal bore and is positioned at least partially inside the axial bore of the body. A center electrode is positioned at least partially inside the axial bore of the insulator. A ground electrode of the spark plug is mounted to the body. The sealing ring is secured to the body in captive fashion. The fastening section has a fastening section outer diameter. A retaining groove is embodied in the body, which has a groove inner diameter that is smaller than the fastening section outer diameter. The sealing ring is reshaped into a conical sealing ring that has an inner section, which engages in the retaining groove and has an internal diameter that is smaller than the fastening section outer diameter.

According to another aspect, the above object may be attained by a spark plug device that has a spark plug and a sealing ring. The spark plug includes a body, which has an axial bore, a fastening section for fastening the spark plug to a cylinder head, and a sleeve sealing surface that is conical in at least some sections. The spark plug also has an insulator that includes a longitudinal bore and is situated at least partially inside the axial bore of the metal sleeve. Finally, the spark plug includes a center electrode, which is positioned at least partially inside the longitudinal bore, and a ground electrode, which is mounted to the body. The sealing ring has a first sealing surface, which is conical in at least some sections and which cooperates with the conical sleeve sealing surface. In addition, the sealing ring has a second sealing surface, which is embodied to cooperate with a sealing surface of a cylinder head.

Finally, the above object may be attained by a method for producing a spark plug device, in particular a spark plug device according to the first or second aspects of the present design, wherein the method can include the following steps:

- preparation of a spark plug that has a fastening section with a fastening section outer diameter and a retaining groove with a groove diameter that is smaller than the fastening section outer diameter; the spark plug also has a conical sealing surface,
- preparation of a sealing ring blank that has a central axis and two end surfaces, at least one of which is oriented essentially perpendicular to the center axis and has a blank inner diameter that is greater than the fastening section outer diameter,
- sliding of the sealing ring blank over the fastening section in the axial direction, and
- pressing of the sealing ring blank against the conical sealing surface so that the sealing ring blank is reshaped into a sealing ring that has an inner section whose diameter is smaller than the fastening section outer diameter.

The spark plug device according to the present design and the associated production method—depending on the embodiment—may have at least one of the following advantages. First of all, the fastening of a sealing ring to a spark plug in captive fashion can be performed by way of a simple axial machining step. A calking in the radial direction is not necessary in this case. In addition, the shaping can be carried out so that the deformation is essentially uniform viewed across the circumference of the sealing ring. As a result, a seal produced by means of the sealing ring can be uniform over the circumference. In addition, the simple axial machining step makes it possible to avoid damage to the sleeve sealing surface during the reshaping. By contrast with so-called folded sealing rings, it is easily possible to achieve a sealing action that is uniform in the circumference direction.

The shaping in which a sealing ring blank is pressed axially against the sleeve sealing surface advantageously results in the fact that the inner diameter of the sealing ring that is reshaped in this way is reduced relative to that of the sealing ring blank. This reduction of the inner diameter can be used to secure the shaped sealing ring to the metal sleeve in captive fashion. It is thus possible by and large to reduce the expense for logistics and storage of the spark plug device.

The inner section of the shaped sealing ring is preferably formed by an inner edge.

The fastening section of the metal sleeve is preferably embodied in the form of an externally threaded section, for example with a thread size of M8, M10, M12, M14, M18, or the like.

By contrast with conventional spark plug devices, when fastening the spark plug device to a cylinder head, an increased sealing pressure can be achieved with the same tightening torque. Consequently, by contrast with the prior art, with a predetermined sealing pressure, it is possible for there to be a lower tightening torque. This can be particularly advantageous if smaller threaded sections, for example M10 or M12, are used.

The sealing ring is preferably a solid sealing ring. An axial thickness of the sealing ring preferably lies in a range from 0.5 to 4 mm, particularly in a range 1 mm to 2 mm. In this connection, this axial thickness is preferably the axial thickness of a sealing ring blank before being deformed against the conical sleeve sealing surface to produce a conical sealing ring.

The sealing surfaces of the metal sleeve and of the sealing ring—as well as a sealing surface of a cylinder head if need be—can be embodied as smooth sealing surfaces, for example with a surface finishing by means of grinding, polishing, or the like. The conical surfaces, however, can also be embodied with an irregular surface quality, in particular with a certain degree of roughness or with flutes, waves, or the like. In addition, the conical surfaces can be interrupted in the axial direction and/or in the circumference direction.

The conical sleeve sealing surface is preferably inclined relative to a longitudinal axis of the spark plug by a sealing surface angle or cone angle that is greater than 0° and less than 90°. In particular, the cone angle lies in a range from 20° to 85°, particularly in a range from 30° to 82°, preferably in a range from 40° to 80°, especially 50° to 75°, and particularly preferably in a range from 55° to 68°.

The sealing ring blank is preferably a flat sealing ring whose end surfaces are oriented perpendicular to a longitudinal axis of the sealing ring. The sealing ring blank preferably has a round outer diameter and/or a round inner diameter. An outer circumference surface and/or an inner circumference surface in this case is preferably oriented parallel to a longitudinal axis.

The production method according to the present design, in which the sealing ring is fastened to the spark plug in captive fashion, can, by way of a sealing ring blank being pushed against a conical sleeve sealing surface exclusively in the axial direction, achieve the fact that after the deformation, the involved sealing surfaces of the sealing ring are uniform over the circumference so that it is possible to achieve a sealing action that is uniform over the circumference. As a result, a good seal in relation to a cylinder head can be achieved, even if this has a socket sealing surface that is porous, for example due to a production method, and is therefore difficult to seal.

It is therefore possible to avoid a complex machining of the socket sealing surface of the cylinder head, for example a polishing of the socket sealing surface.

The spark plug device according to the present design and its production method can be used with a wide range of spark plugs and other ignition devices, including spark plugs for automotive applications, including diesel glow plugs, including industrial spark plugs, ignition devices for aviation, or any other device that is used to ignite a fuel/air mixture in an engine. This includes spark plugs that are used in internal combustion engines of motor vehicles, which are equipped to provide a gasoline direct injection (GDI), as well as the spark plugs that are used in engines that operate with lean combustion strategies. This also includes spark plugs that are used in engines that operate with strategies that permit effective fuel utilization and/or that are operated with strategies for reducing emissions or combinations of such engines. In the present context, the terms "axial," "radial," and "circumferential/tangential" describe directions with reference to the generally cylindrical form of such a spark plug and, provided that nothing to the contrary is specified, relate to a longitudinal axis of the spark plug. The body of the spark plug is preferably made of metal and is preferably embodied in the form of a metal sleeve. The retaining groove of the body is preferably embodied in the form of a thread recess.

According to one example, the sealing ring has a first sealing surface, which is associated with the sleeve sealing surface and which, at least in sections, is embodied as a conical surface whose cone angle relative to a longitudinal axis lies in a range from 20° to 85°, preferably in a range from 30° to 82°, particularly in a range from 40° to 80°, especially 50° to 75°, preferably from 55° to 68°, and preferably from 62° to 64°.

The cone angle of the first sealing surface in this connection is preferably identical to the cone angle of the sleeve sealing surface.

According to another example, the sealing ring has a second sealing surface that is oriented toward a cylinder head sealing surface.

The second sealing surface of the reshaped sealing ring can generally be oriented perpendicular to a longitudinal axis. In this case, a cylinder head sealing surface is likewise oriented perpendicular to a longitudinal axis of a spark plug socket.

It is preferable, however, if the second sealing surface, at least in sections, is embodied as a conical surface whose cone angle relative to a longitudinal axis lies in a range from 20° to 85°.

Preferably, the cone angle of the second sealing surface lies in the same angular range as the cone angle of the first sealing surface. It is particularly preferable if the first sealing surface and the second sealing surface are oriented parallel to each other.

As explained above, it is particularly preferable if the conical sleeve sealing surface has a cone angle relative to a longitudinal axis that lies in a range from 20° to 85°.

It may also be advantageous if the sealing ring is reshaped into its conical form in that a sealing ring blank has been pressed against the conical sleeve sealing surface.

It may also be advantageous if the sealing ring is embodied of one piece and/or if the sealing ring is made of a metal material, in particular of a soft metal material such as a copper material, an aluminum material, a soft steel material, or an alloy of one or more of these materials.

With the spark plug device according to the present design, it is possible to produce a sealing ring device for a cylinder head; the cylinder head has at least one spark plug socket, which defines an internally threaded section and a socket sealing surface; the socket sealing surface, at least in some sections, is embodied as a conical surface, which has a cone angle relative to a longitudinal axis that lies in a range from 20° to 85°. The cone angle of the socket sealing surface can be identical to the cone angle of the sleeve sealing surface. Preferably, however, the cone angle of the socket sealing surface is 1° to 10° smaller than the cone angle of the sleeve sealing surface, in particular 1.5° to 5° smaller, and preferably 2° to 4° smaller.

In this case, the second sealing surface can be embodied as parallel to the socket sealing surface; it can, however, also be embodied as or be oriented parallel to the first sealing surface, i.e. parallel to the sleeve sealing surface.

Naturally, the features mentioned above and explained below can be used not only in the respectively indicated combination, but can also be used in other combinations or by themselves without going beyond the scope of the present invention.

DRAWINGS

Preferred exemplary embodiments will be described below in conjunction with the accompanying drawings in which elements that are the same are labeled with the same reference numerals and wherein.

DESCRIPTION

Figure 1:
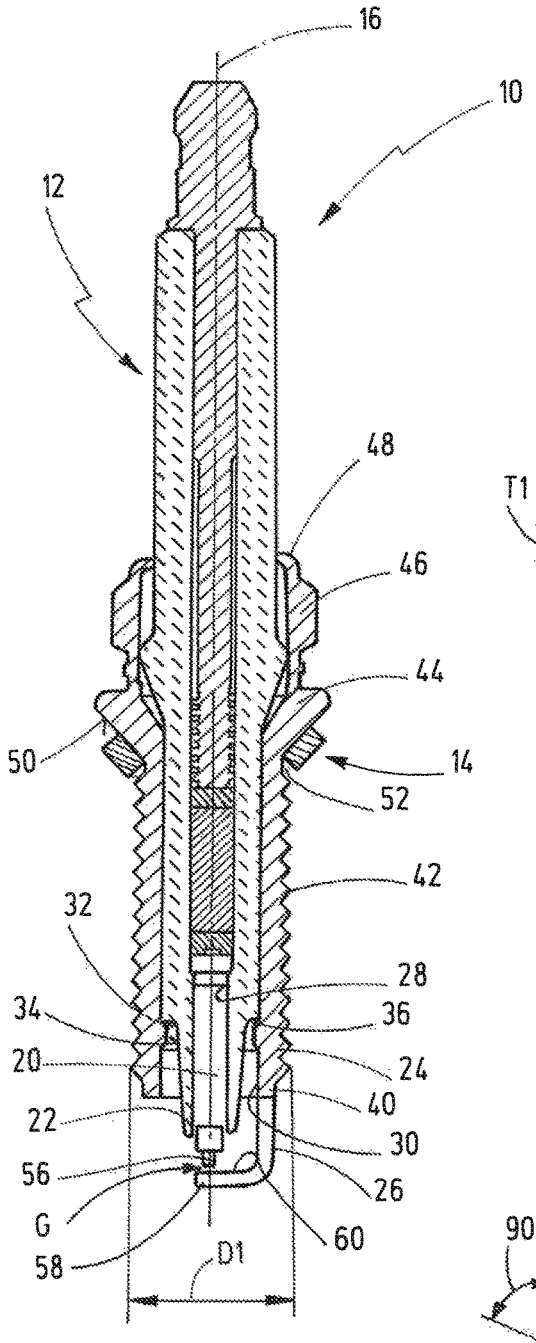
FIG. 1 shows a longitudinal sectional view through an embodiment of a spark plug device.

FIG. 1 schematically depicts a longitudinal section through a spark plug device, which is generally labeled with the reference numeral 10. The spark plug device 10 includes a spark plug 12 and a sealing ring 14 for sealing against a cylinder head that is not shown. The spark plug 12 and the sealing ring 14 are generally oriented along a longitudinal axis 16.

The spark plug 12 includes a center electrode 20, an insulator 22, a body (metal sleeve) 24 and a ground electrode 26. The insulator 22 has a longitudinal bore 28 inside which at least one section of the center electrode 20 is positioned. The center electrode 20 includes an end section that extends out from the insulator 22 in the axial direction toward an ignition end of the spark plug 12. The center electrode 20 can, for example, be made of a nickel-based alloy material and can optionally contain a copper core for conducting heat inside the center electrode 20. Other materials and configurations are also possible, including a center electrode 20 without a copper core, i.e. integrally composed of a single material. The center electrode 20 can include a separate ignition tip, a plate, or another piece composed of a precious metal alloy such as elements that are made of platinum, iridium, ruthenium, palladium, rhodium, or a combination thereof. On the other hand, the center electrode 20 can also be made without such a separate ignition tip or ignition coating.

The insulator 22 is generally positioned inside an axial bore 30 of the body 24 and has an end section or nose section that lies exposed outside the body 24 at the ignition end of the spark plug 12. The insulator 22 is made of a material such as a ceramic material, which electrically insulates the center electrode 20 from the body 24. According to the non-limiting example shown in FIG. 1, the insulator 14 [sic] includes an external shoulder 32, which is supported by an internal shoulder 34 of the body 24 in such a way that the two components are matched to each other and are sealed against each other with an annular sealing element 36. Naturally, instead of this, other insulator materials and configurations can be used, including those with multiple external shoulders and sealing elements.

The body 24 constitutes an external structure or housing for the spark plug 12 and includes a free end section 40, a fastening section in the form of a threaded section 42 for installation in a cylinder head of an engine, an external shoulder 44 for producing a seat on the cylinder head, a for example hexagonal installation section 46 for use with an installation tool that is not shown in detail, and a closed end section 48, which is crimped or clamped against the insulator 22.

The body 24 can be made of a number of types of steel or of another suitable material and can also be coated with a zinc-based or nickel-based alloy coating, just to give an example. The threaded section 42 extends between the free end section 40 and the external shoulder 44. Depending on the respective application for which the spark plug 12 is designed, the threaded section 42 can have external threads with a number of conventional diameters (e.g. M14, M12, M10, M8, etc.). The external shoulder 44 extends radially outward from the threaded section 42 and includes a conical sleeve sealing surface 50. When the spark plug 12 is installed by means of thread engagement in the cylinder head, the sealing ring 14, which is preferably secured to the spark plug 12 in captive fashion, is squeezed or compressed between the conical sleeve sealing surface 50 and a corresponding sealing surface of the cylinder head. This produces an air-tight seal that prevents exhaust gases from blowing out. The hexagonal installation section 46 is designed to accommodate a wrench or another installation tool or assembly tool so that the spark plug can be screwed into the cylinder head with a suitable amount of torque. Naturally, the materials and configurations shown in FIG. 1 are merely examples and it is also possible to use other designs, including designs of sleeves with shorter threaded sections (e.g. shorter screw-in lengths). In the axial direction between the threaded section 42 and the external shoulder 44, the body 24 has a retaining groove 52 whose diameter is smaller than an external diameter D1 of the threaded section 42 shown in FIG. 1.

The ground electrode 26 is mounted to the free end section 40 of the body 24 and, as a finished product, can have a standard J-gap configuration or another suitable configuration.

At a free axial end of the center electrode 20, an ignition tip 56 can be provided, which, as described above, can contain a precious metal.

A free end section 58 of the ground electrode 26 can be bent, for example, by 90° relative to the longitudinal axis 16 so that a side surface 60 of the ground electrode 26 and/or of its ignition tip 36 is situated on the other side of a spark gap G from the end section of the center electrode 20 in the axial direction. Like the center electrode 20, the ground electrode 26 can be made of a nickel-based alloy material, which serves as an external section or a casing section of a body and can include a copper-alloy material or copper-based alloy material that serves as a thermally conductive inner core; other examples are possible, including ground electrodes 26 without a core, which are made of a single material. Some non-limiting examples of nickel-based alloy materials that can be used in connection with the center electrode 20 and/or the ground electrode 26 include alloys that are composed of nickel (Ni) together with chromium (Cr), iron (Fe), aluminum (Al), manganese (Mn), silicon (Si), other elements, or a combination thereof. Even more specific examples of possible alloys include materials that are conventionally known as Inconel 600 or 601. In its cross-sectional profile, the ground electrode 26 can have a generally rectangular form or another suitable profile form. The ground electrode 26 can include a separate ignition tip 56, an ignition plate, or an ignition element that is made of a precious metal-based alloy such as an alloy made of platinum, iridium, ruthenium, palladium, rhodium, or a combination thereof. In other embodiments, the ground electrode 26 is produced without such a separate ignition tip or ignition coating. In general, the spark plug can have any known electrode configuration, in particular an electrode configuration for prechamber spark plugs.

As shown in FIG. 1, the sleeve sealing surface 50 is embodied as generally conical. The sealing ring 14 is likewise embodied as a conical sealing ring, which can be embodied approximately in the shape of a truncated cone when viewed from the side.

The sealing ring 14 has been reshaped out of a sealing ring blank 70 into the conical shape after the sealing ring blank 70 was slid over the threaded section 42 in the axial direction from the free end of the spark plug 12 until the sealing ring blank was positioned in the region of the retaining groove 52. Starting from this position, the sealing ring blank has then been reshaped into the shape of a sealing ring 14 shown in FIG. 1 in that an inner diameter of the sealing ring that has been reshaped in this way is smaller than the outer diameter D1 of the threaded section 42. In this way, the sealing ring 14 shown in FIG. 1 is secured to the metal sleeve 24 of the spark plug 12 in captive fashion.

FIGS. 2 through 5 schematically depict how a sealing ring 14 is produced from a sealing ring blank 70.

Figure 2:
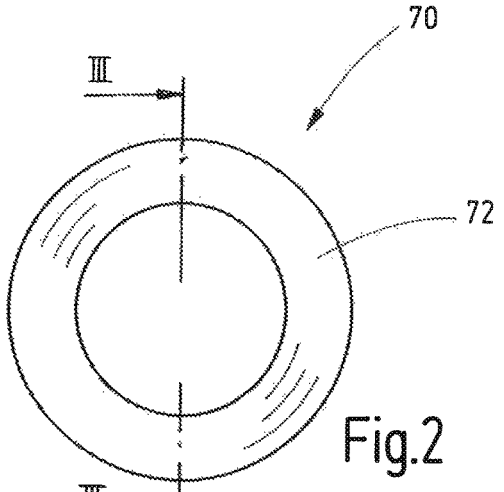
FIG. 2 is a top view of a sealing ring blank.
Figure 3:
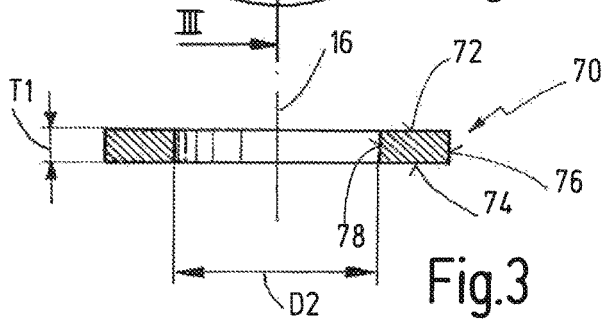
FIG. 3 shows a sectional view along the line in FIG. 2.

The sealing ring blank shown in FIGS. 2 and 3 is embodied as a flat, solid sealing ring made of a material such as copper, steel, aluminum, a combination thereof, or an alloy of one or several of these materials. The sealing ring blank 70 has a first end surface 72 and a second end surface 74, which are generally oriented perpendicular to a longitudinal axis 16. The sealing ring blank 70 also has an inner diameter D2 that is greater than the outer diameter D1 of the threaded section 42. The sealing ring blank 70 can therefore be slid axially over this threaded section 42 without damaging the threaded section 42.

The sealing ring blank 70 also includes an outer circumference surface 76, which is generally embodied as a cylindrical surface and which is also preferably oriented parallel to the longitudinal axis 16. The sealing ring blank 70 also includes an inner circumference surface 78 that defines the inner diameter D2 and that is preferably also embodied as a cylindrical surface, preferably parallel to the longitudinal axis 16.

Figure 4:
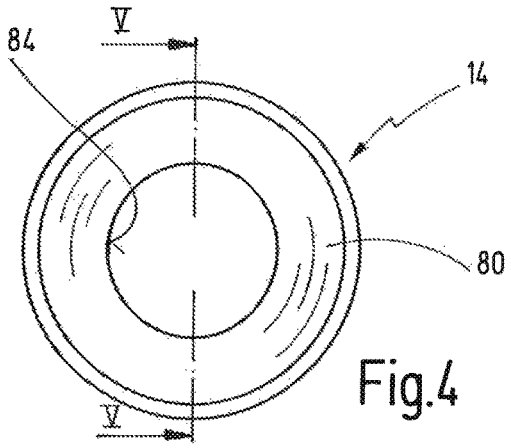
FIG. 4 is a top view of a sealing ring, which is made from the sealing ring blank in FIGS. 2 and 3.
Figure 5:
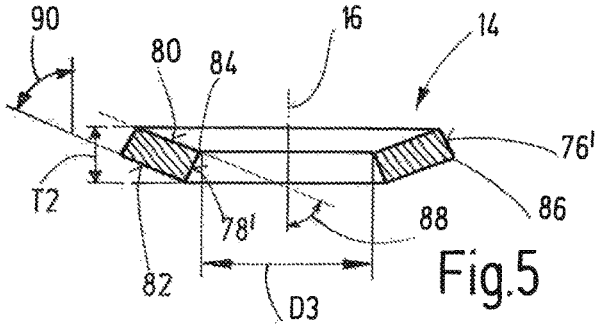
FIG. 5 is a sectional view along the line V-V in FIG. 4.

In order to produce the sealing ring 14 shown in FIG. 1, the sealing ring blank shown in FIGS. 2 and 3 is reshaped, as shown in FIGS. 4 and 5. In this connection, the sealing ring blank 70 is in particular pressed against the conical sleeve sealing surface 50.

The sealing ring 14 produced in this way based on a plastic reshaping has a first sealing surface 80, which was originally the first end surface 72, and a second sealing surface 82, which was originally the second end surface 74. Because of the reshaping into the conical form, an inner circumference surface 78' is now inclined relative to the longitudinal axis 16 and constitutes an inner circumference edge 84, which defines the inner diameter D3 of the reshaped sealing ring 14. The inner diameter D3 is smaller than the outer diameter D1 of the threaded section 42. The inner edge 84 of the reshaped sealing ring 14 engages in the retaining groove 52 and is thus secured to the body 24, in particular to its thread 42, in captive fashion.

An outer circumference surface 76' of the reshaped sealing ring 14 is likewise inclined relative to the longitudinal axis 16. The outer circumference surface 76' in this case defines an outer edge 86 that defines the maximum outer diameter of the sealing ring 14.

The first sealing surface 80 is oriented at a first cone angle 88 relative to the longitudinal axis 16. The second sealing surface 82 is oriented at a second cone angle 90 relative to the longitudinal axis 16.

The cone angles 88, 90 can, for example, lie in a range from 20° to 85°, preferably in a range from 30° to 82°, particularly in a range from 40° to 80°, preferably from 50° to 75°, and particularly in a range from 55° to 68°.

Figure 6:
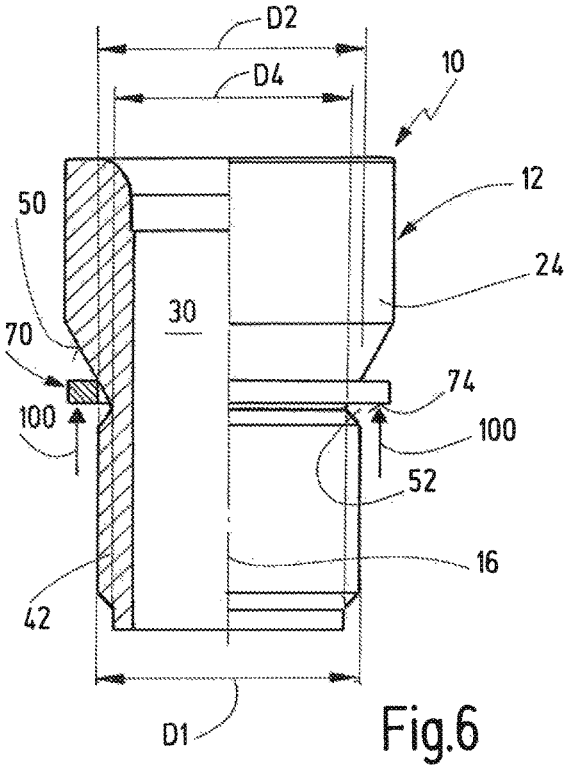
FIG. 6 is a depiction of a spark plug device according to another embodiment, with a sealing ring blank that has been slid over a threaded section of a metal sleeve of a spark plug and has not yet been reshaped into a sealing ring.
Figure 7:
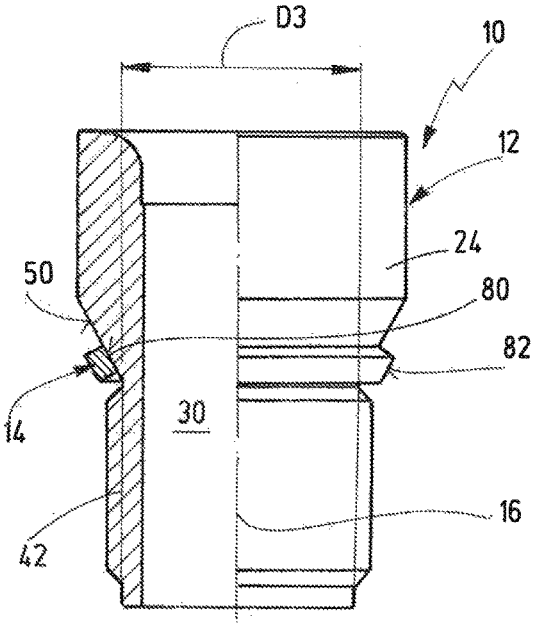
FIG. 7 is a depiction comparable to FIG. 6 in which the sealing ring blank from FIG. 6 has been reshaped into a sealing ring with at least one conical sealing surface.

FIGS. 6 and 7 show another embodiment of a spark plug device 10 that includes a spark plug 12 and a sealing ring 14; FIG. 6 shows how a sealing ring blank 70 has been slid in the axial direction over the threaded section 42 of the body 24 of the spark plug 12 in such a way that it is oriented axially with the retaining groove 52.

FIG. 6 also shows that by means of a schematically depicted shaping tool 100, an axial force is exerted on the second end surface 74 of the sealing ring blank in such a way that the sealing ring blank 70 is pressed against the conical sleeve sealing surface 50 and reshaped in such a way that its first sealing surface 80 and its second sealing surface 82 are oriented parallel to the sleeve sealing surface 50 or are oriented at least approximately parallel to it. The reshaping of the sealing ring blank 70 into the sealing ring 14 is a plastic reshaping. In the course of this, the inner diameter of the sealing ring blank is reduced to a value D3 (see FIG. 7) that is greater than the inner diameter D4 (see FIG. 6) of the retaining groove 52, but is smaller than the outer diameter D1 of the threaded section 42.

Figure 8:
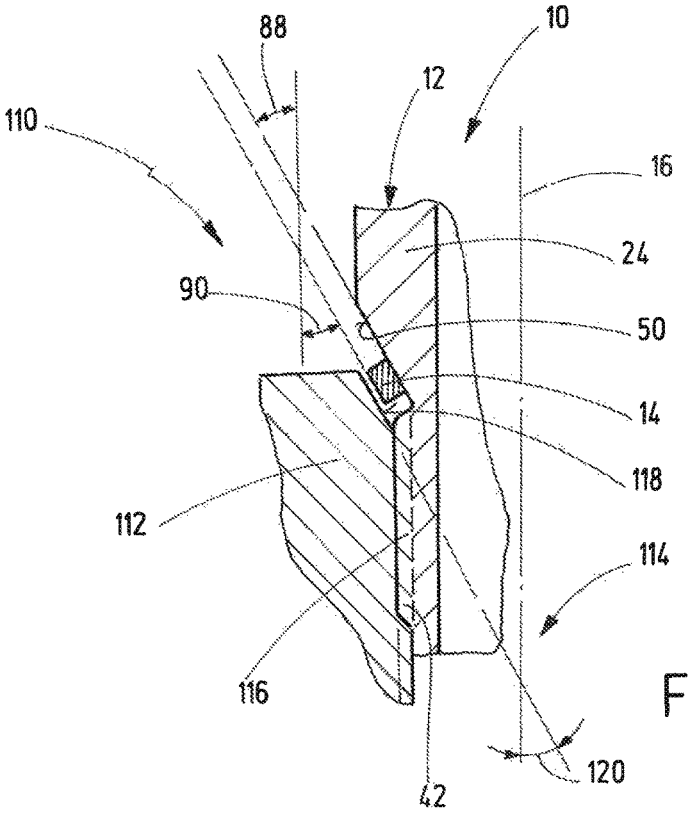
FIG. 8 is a schematic depiction of a sealing device in which a conical sealing ring is positioned between the conical sleeve sealing surface of a metal sleeve of a spark plug device and a conical socket sealing surface of a spark plug socket of a cylinder head.

FIG. 8 schematically depicts a state in which a spark plug 12 of a spark plug device 10 is being screwed into a spark plug socket of a cylinder head.

In its design and function, the spark plug device 10 generally corresponds to the spark plug devices described above. Elements that are the same have therefore been labeled with the same reference numerals.

In the present case, a sealing device 110 is formed by the spark plug 12 being screwed into the cylinder head. The sealing device 110 seals the spark plug 12 against a cylinder head 112, which has a spark plug socket 114 with a bore that is equipped with an internally threaded section 116. The spark plug socket 114 also includes a socket sealing surface 118 that is conical at least in some sections.

When the sealing device 110 is being produced, the conical sealing ring 14 is compressed between the conical sleeve sealing surface 50 and the conical socket sealing surface 118.

The first sealing surface 80 of the sealing ring 14, which is associated with the sleeve sealing surface 50, is oriented at an angle 88 relative to the longitudinal axis 16, which angle is of the same magnitude as the cone angle of the sleeve sealing surface 50.

The second sealing surface 82 is oriented at a second cone angle 90 relative to the longitudinal axis 16.

The socket sealing surface 118 is oriented at a cone angle 120 relative to the longitudinal axis 16.

The second cone angle 90 and/or the cone angle 120 of the socket sealing surface 118 can be of the same magnitude as the first cone angle 88. The second cone angle 90 and/or the cone angle 120 of the socket sealing surface 118, however, can also differ from the magnitude of the first cone angle 88, for example by an angular magnitude in a range from 1° to 10°, particularly in a range from 1.5° to 5°, preferably in a range from 2° to 4°.

It is particularly preferable if the cone angle 88 of the sleeve sealing surface 50 is greater than the cone angle 120 of the socket sealing surface 118.

This measure makes it possible to achieve the fact that as it is being compressed, the sealing ring 14 has less of a tendency to be pushed axially away from the thread section 42. As a result, it may be possible to reduce a tensile stress on the material of the sealing ring 14 in the circumference direction.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug device, comprising:

a spark plug that includes:

a body that has an axial bore, a threaded section for fastening the spark plug to a cylinder head, and a conical sleeve sealing surface that is conical at least in some sections, the threaded section includes a threaded section outer diameter and a retaining groove that is embodied in the body and has a groove diameter that is smaller than the threaded section outer diameter;

an insulator that has a longitudinal bore and is positioned at least partially inside the axial bore of the body;

a center electrode that is positioned at least partially inside the longitudinal bore of the insulator; and a ground electrode that is, mounted to the body; and a sealing ring that is secured to the body in a captive fashion and has an inner section and an inner diameter, wherein the sealing ring is reshaped into a conical sealing ring so that the inner section engages in the retaining groove and the inner diameter is smaller than the threaded section outer diameter.

2. The spark plug device according to claim 1, wherein the sealing ring has a first sealing surface that is associated with the sleeve sealing surface and, at least in some sections, is embodied as a conical surface whose cone angle relative to a longitudinal axis lies in a range from 20° to 85°.

3. The spark plug device according to claim 1, wherein the sealing ring has a second sealing surface that is associated with a cylinder head sealing surface.

4. The spark plug device according to claim 3, wherein at least in some sections, the second sealing surface is embodied as a conical surface whose cone angle relative to a longitudinal axis lies in a range from 20° to 85°.

5. The spark plug device according to claim 1, wherein the conical sleeve sealing surface has a cone angle relative to a longitudinal axis that lies in a range from 20° to 85°.

6. The spark plug device according to claim 1, wherein the sealing ring is reshaped into its conical shape by pressing a sealing ring blank against the conical sleeve sealing surface.

7. The spark plug device according to claim 1, wherein the sealing ring is made of one piece.

8. The spark plug device according to claim 1, wherein the sealing ring is made of copper, aluminum, steel, a copper alloy, an aluminum alloy, a steel alloy, or any combination thereof.

9. A spark plug device, comprising:

a spark plug that includes:

a body that has an axial bore, a fastening section for fastening the spark plug to a cylinder head, and a conical sleeve sealing surface that is conical at least in some sections, an insulator that has a longitudinal bore and is positioned at least partially inside the axial bore of the body;

a center electrode that is positioned at least partially inside the longitudinal bore of the insulator; and a ground electrode that is mounted to the body; and a sealing ring that has a first sealing surface and a second sealing surface, wherein the first sealing surface is conical at least in some sections and cooperates with the conical sleeve sealing surface, and the second sealing surface is designed to cooperate with a sealing surface of a cylinder head, and wherein the conical sleeve sealing surface of the body is axially longer than the first sealing surface of the sealing ring, or axially longer than the second sealing surface of the sealing ring, or axially longer than both the first sealing surface and the second sealing surface of the sealing ring.

10. A method for producing the spark plug device of claim t wherein the method comprises the following steps:

preparing the spark plug that has the threaded section with the threaded section outer diameter and the retaining groove, the retaining groove has the groove diameter that is smaller than the fastening section outer diameter, and the spark plug also has the conical sleeve sealing surface;

providing a sealing ring blank that has, a center axis, two end surfaces, and a blank inner diameter, at least one of the two end surfaces is oriented essentially perpendicular to the center axis, and the blank inner diameter is greater than the threaded section outer diameter;

sliding the sealing ring blank over the threaded section in an axial direction; and pressing the sealing ring blank against the conical sleeve sealing surface so that the sealing ring blank is reshaped into the sealing ring that has the inner section whose diameter is smaller than the threaded section outer diameter.

* * * * *